United States Patent [19]

Bessouat et al.

[11] 4,248,181

[45] Feb. 3, 1981

[54] VERTICAL STEAM SEPARATOR-SUPERHEATER

[75] Inventors: Roger Bessouat; Jacques Marjollet, both of Paris, France

[73] Assignee: Stein Industrie, Velizy Villacoublay, France

[21] Appl. No.: 950,299

[22] Filed: Oct. 11, 1978

[51] Int. Cl.[3] ..... F22B 1/06

[52] U.S. Cl. ..... 122/483; 122/34

[58] Field of Search ..... 122/3, 34, 483

[56] References Cited

U.S. PATENT DOCUMENTS

| | | | |
|---|---|---|---|
| 3,923,009 | 12/1975 | Sohma | 122/34 |
| 4,103,647 | 8/1978 | Dorling et al. | 122/34 X |

*Primary Examiner*—Edward G. Favors

[57] ABSTRACT

A vertical steam separator-superheater suitable for drying and superheating steam coming from a high-pressure expansion turbine.

The separator-superheater has a common casing (1), enclosing a lower portion (3) which forms a separation zone and an upper portion (4) which forms a superheating zone, which has an axial dry steam inlet zone (15). Nests of superheater tubes are disposed in tubular modules 16 and 17 which are spaced out around the axial zone. A peripheral superheated steam collection zone (18) surrounds the superheater modules. The tubular modules of the superheater tubes are fixed to a thin flexible casing (30) which is itself fixed to the upper end (31) of the common casing. This arrangement reduces the number of expansion bends which would otherwise be required.

5 Claims, 6 Drawing Figures

VERTICAL STEAM SEPARATOR-SUPERHEATER

The present invention relates to a vertical steam separator-superheater.

The Applicant's French Pat. No. 2,187,394 discloses a separator-superheater of this type which is used in particular to dry and superheat steam which comes from a high-pressure expansion turbine before entering a lower pressure expansion turbine. Superheating is by heat exchange with steam at a higher pressure. Since there is great expansion and contraction in the nests of superheated steam tubes, it has been found necessary to use particular devices, for example expansion bends, designed to allow such expansion and contraction without excessive stresses. Such devices are relatively bulky and complicate access to the nests of superheating tubes.

Preferred embodiments of the present invention mitigate this drawback and provide a vertical steam separator-superheater which can absorb expansion and contraction of the nests of tubes without requiring special devices such as expansion bends while still allowing easy removal of the nests of tubes for repair.

The present invention provides a vertical steam separator-superheater which has a common casing enclosing a lower portion which forms a separation zone and an upper portion which forms a superheating zone, an axial dry steam inlet zone, tubular nests of superheated tubes disposed in envelopes spaced out around the central zone and a peripheral superheated steam collection zone, wherein the envelopes of the nests of superheater tubes are fixed to a thin and flexible casing which is itself fixed to the upper end of the common casing.

Preferably it also includes at least one of the following characteristics:

a toroidal superheated steam supply manifold in its upper end, connected by short tubes to the upper ends of the nests of superheater tubes;

an annular wet steam inlet chamber in its lower portion connected firstly to wet steam inlet openings disposed so as to impart turbulent motion to the steam and secondly by the base to the bottom of an axial zone provided with separators via passages which change the direction of the steam by about 180°; and the axial zone provided with separators is offset in relation to the common casing towards the side opposite to the wet steam inlet openings so as to make the speed of the steam substantially constant in the annular inlet chamber.

A vertical steam separator-superheater in accordance with the invention is described hereinbelow by way of example and with reference to the accompanying drawings in which.

Figure 1:
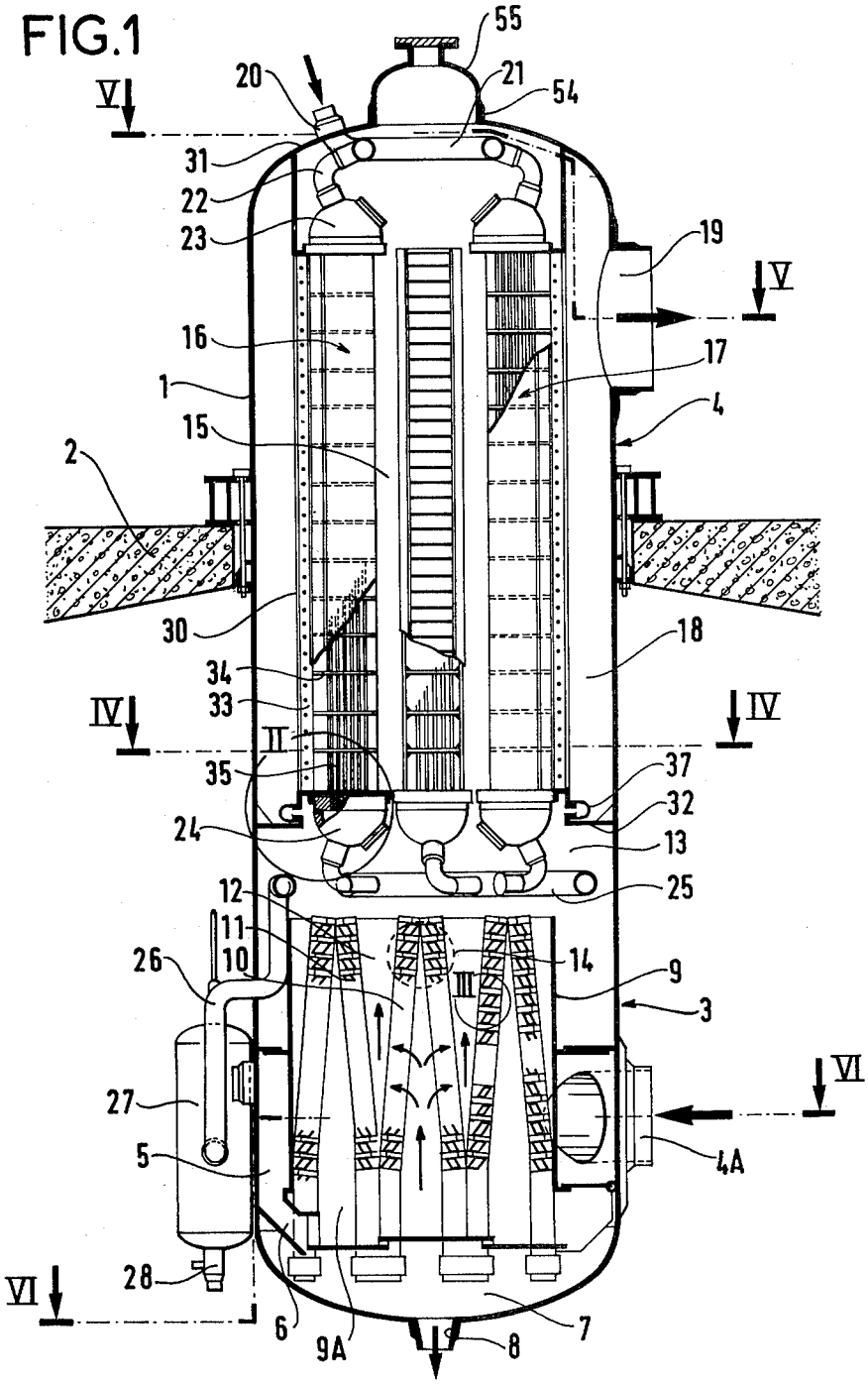
FIG. 1 is a vertical cross-section view of the superheater, with the envelopes of the nests of superheater tubes partially cut away.
Figure 6:
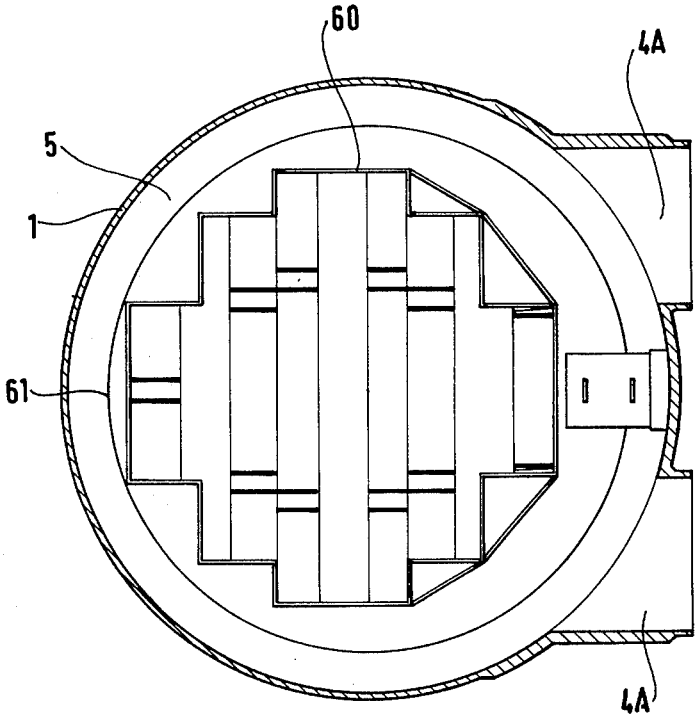
FIG. 6 is a diametral cross-section along an axis VI—VI in FIG. 1.

In FIG. 1, the separator-superheater includes an outer pressure-resistant casing 1 supported by a conventional annular support resting on a floor 2. The separator-superheater has a lower portion 3 (which forms a separator) and an upper portion 4 (which forms a superheater). The lower portion is fitted with wet steam supply tube 4A, which communicate with an annular chamber 5. In its lower portion, the annular chamber 5 has a passage 6 which communicates with the bottom of a central zone 9 which contains the actual separators. To keep steam speed and hence wet steam flow constant round the whole periphery of the central zone 9, the latter, delimited by prismatic steel-work 60 (FIG. 6) is offset in relation to the axis of the separator-superheater, so that its axis is further from the supply tubes 4A. The turbulent flow in the chamber 5 causes a first separation of the droplets of water entrained by the steam. Further, the separator components in the central zone 9 are disposed so that steam enters the central zone only after its direction has changed by 180° in the input pre-separator delimited by the edge 61 which completes the preliminary separation of the droplets contained in the steam. The separated water is collected in the bottom 7 of the casing and is drained off through a tube 8.

The partially dried steam then rises vertically in gaps such as 9A between stacks 10 and 11 of separator components formed by bundles of parallel corrugated steel sheets of known type. To distribute steam fairly evenly among the various separator components, the gap between two stacks of separator components tapers from the bottom to the top.

Figure 3:
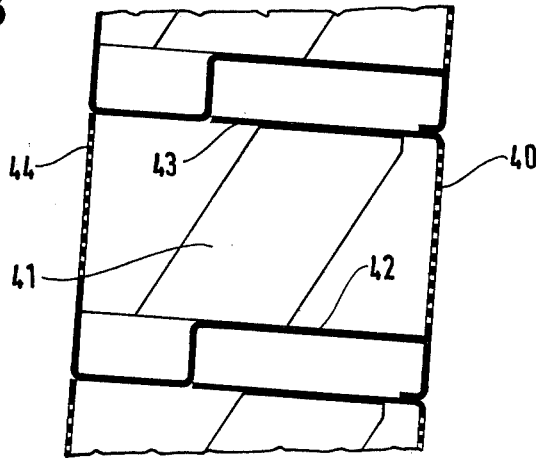
FIG. 3 is an enlarged view of a detail III in FIG. 1, showing a separator component.

The structure of a separator component is illustrated on a larger scale in FIG. 3. Each component comprises an inlet grating 40 which distributes the steam flow evenly between parallel corrugated steel sheets 41 which are disposed between parallel lower and upper partitions 42 and 43 and an outlet grating 44.

The dry saturated steam which leaves the separators is collected in the gaps such as 12 between stacks of separators which are disposed so that the speed of the steam will be the same after it has left the separators as before it entered them. The dry steam then reaches an intermediate zone 13 of the separator-superheater. A fraction of the total flow—for example 10%—can be drawn off directly before superheating via an outlet tube 14.

Figure 2:
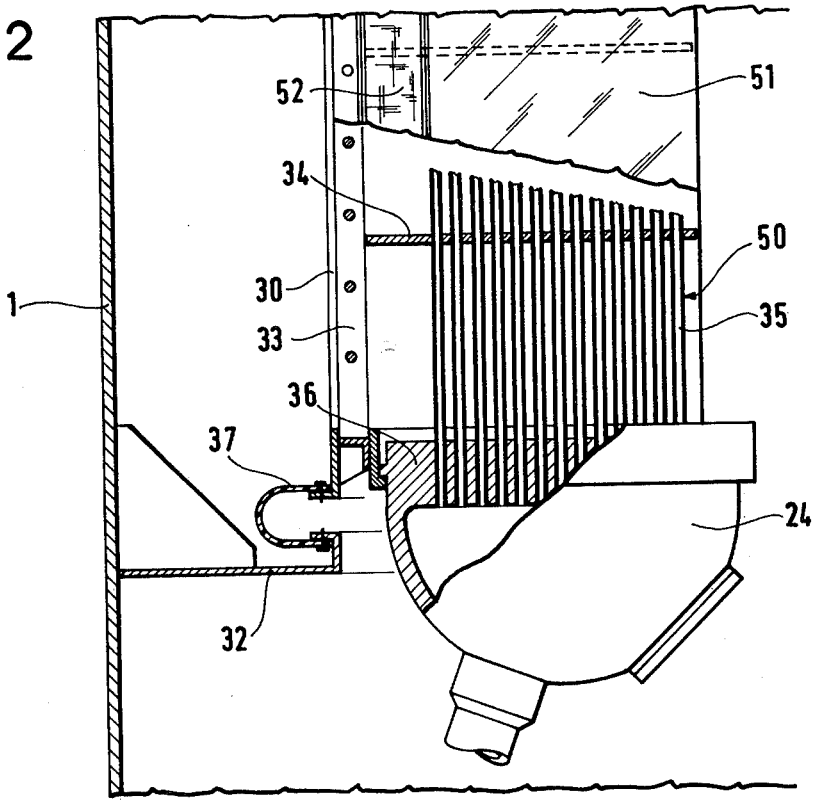
FIG. 2 is a view on an enlarged scale of the detail II in FIG. 1, showing the lower portion of the thin inner casing and of a nest of superheating tubes.

The remainder of the dry saturated steam rises into the upper portion 4 through an axial zone 15 thereof extending between four superheater modules such as 16 and 17. These superheater modules are fixed by means of angle bars 33 (see FIG. 2) on the inner surface of a thin casing 30 which is itself welded by its upper edge to the head end 31 of the separator-superheater. The lower edge of the casing 30 is connected by expansion bellows 37 to a horizontal edge 32 which is itself welded to the inner wall of the outer casing 1.

The superheater modules are supplied with high-pressure steam via a tube 20, a toroidal manifold 21 and connections 22 which communicate with end chambers 23. Nests of tubes are formed by parallel finned tubes 35 fixed in tubular plates such as 36. Condensed superheated steam collects in chambers such as 24 which are connected to a manifold 25. The condensate is collected in a receiving cylinder 27 via a pipe 26, and then the receiving cylinder is drained via a tube 28.

Expansion and contraction due to variations in temperature are absorbed by fixing the superheater modules to a thin and flexible inner casing without fitting expansion bends or other special expansion compensating devices on the steam supply tubes.

Further, when one of the modules needs to be repaired, it can therefore independently be removed from the separator-superheater through the toroidal manifold 21 and an orifice 54 which is normally closed by a lid 55.

Figure 4:
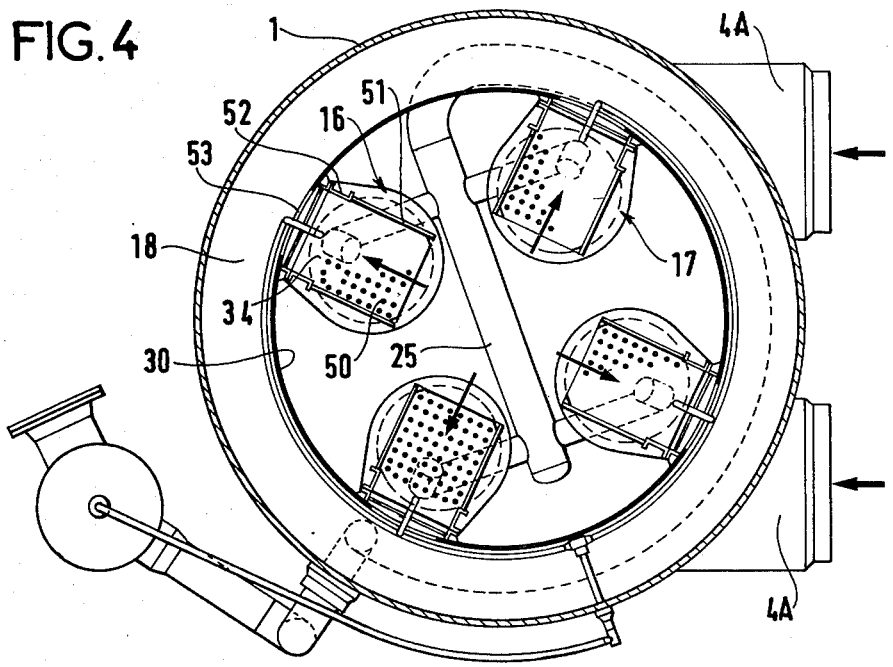
FIG. 4 is a diametral cross-section along an axis IV—IV in FIG. 1.
Figure 5:
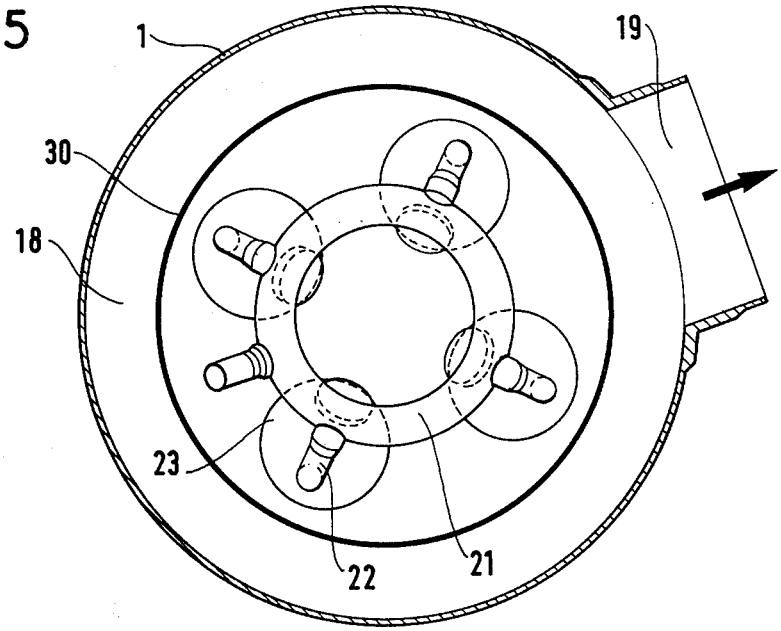
FIG. 5 is a cross-section along an axis V—V in FIG. 1.

The superheater modules have regularly spaced horizontal steel sheets 34 fixed on either side to the vertical steel sheets 51 (FIG. 4) which are themselves fixed by vertical angle bars 52 to the inner casing 30.

The tubes which form a nest of tubes pass with some clearance through horizontal steel sheets 34 which divide and channel the flow of steam to be superheated. The steam flows through the nests of tubes such as 50, then through the corresponding openings such as 53 in the inner casing 30 until it reaches a peripheral chamber 18. It then communicates with a load, for example an expansion turbine, via a tube 19.

Although the separator-superheater which has just been described with reference to the drawings appears to be the preferable embodiment of the invention, it will be understood that various modifications can be made thereto without going beyond the scope of the invention; some of its components can be replaced by others which would fulfill an identical or analogous function. In particuler, the separator blocks can be other than bundles of parallel corrugated steel sheets and can be constituted for example by gratings, successive baffle plates, etc. The nests of superheating tubes can be provided without fins or be provided with other auxiliary components for improving the coefficient of heat exchange. There can be more or less than four such nests of tubes.

I claim:

1. A vertical steam separator-superheater comprising a common casing enclosing a lower portion which forms a separation zone and an upper portion which forms a superheating zone; a thin, flexible casing fixed to the common casing at its upper end; an axial dry steam inlet zone within the superheating zone; tubular nests of superheater tubes disposed in envelopes spaced out around the dry steam inlet zone and fixed to said thin, flexible casing; and a peripheral superheated steam collection zone.

2. A separator-superheater according to claim 1, further comprising, at its upper end, a toroidal superheated steam supply manifold and a plurality of short tubes connecting said manifold to the upper ends of the nests of superheater tubes.

3. A separator-superheater according to claim 1, wherein the lower portion includes an annular wet steam inlet chamber; wet steam inlet openings connected to said wet steam inlet chamber and disposed so as to impart turbulent motion to the steam; and an axial zone provided with separators and connected at its bottom to the base of the wet steam inlet chamber via passages which change the direction of the steam by about 180°.

4. A separator-superheater according to claim 3, wherein the axial zone provided with separators is offset in relation to the common casing towards the side opposite to the wet steam inlet openings so as to make the speed of the steam substantially constant in the annular inlet chamber.

5. A separator-superheater according to one of claims 1–4, wherein each of the nests of superheater tubes can be detached independently from the others and can be removed through an orifice in the upper portion of the common casing.

* * * * *